US006519852B1

(12) United States Patent
Chen

(10) Patent No.: US 6,519,852 B1
(45) Date of Patent: Feb. 18, 2003

(54) METHOD OF MANUFACTURING AN ALUMINUM ALLOY WHEEL RIM

(75) Inventor: Chien-Cheng Chen, Taipei (TW)

(73) Assignee: Yuecom Manufacturing Co., Ltd., Taipei Hsien (TW)

( * ) Notice: Subject to any disclaimer, the term of this patent is extended or adjusted under 35 U.S.C. 154(b) by 0 days.

(21) Appl. No.: 09/912,355

(22) Filed: Jul. 26, 2001

(51) Int. Cl.[7] ..... B21K 1/38
(52) U.S. Cl. ..... 29/894.353; 72/307
(58) Field of Search ..... 29/894.35–894.354; 72/51, 307, 415

(56) References Cited

U.S. PATENT DOCUMENTS 4,266,417 A * 5/1981 Imamura et al. ..... 29/894.354
4,674,165 A * 6/1987 Spath ..... 29/894.354

* cited by examiner

*Primary Examiner*—P. W. Echols
(74) *Attorney, Agent, or Firm*—Bacon & Thomas

(57) ABSTRACT

A method of manufacturing a wheel rim for a motor vehicle comprises the steps of a strip of aluminum alloy sheet material having a predetermined cross-section suitable for forming into a wheel rim by extrusion molding, pressing the strip step-by-step lengthwise by an upper mold and a lower mold having complimentary profiles for causing the strip to have predetermined profiles as a hoop with a formed gap between the both ends, welding the gap to form an unfinished wheel rim, and annealing, shaping, heat treating, and polishing the unfinished wheel rim to form a finished wheel rim.

11 Claims, 6 Drawing Sheets

METHOD OF MANUFACTURING AN ALUMINUM ALLOY WHEEL RIM

FIELD OF THE INVENTION

The present invention relates to the field of wheel rim manufacturing and more particularly to an improved method of manufacturing an aluminum alloy wheel rim.

BACKGROUND OF THE INVENTION

Methods for making wheel rims are well known. For example, U.S. Pat. No. 4,589,177 to Secolo et al. and U.S. Pat. No. 4,185,370 to Evens both disclosed such methods. The method of Evans's Patent is illustrated in FIGS. 1 to 3. In FIG. 1, a strip 1 of aluminum sheet material used to form a wheel rim is shown. In FIG. 2, such strip 1 is formed into a hoop 3 and the opposing ends flash butt welded forming weld line 2. The thus formed hoop is subsequently passed through multiple forming operations (e.g., press and roll forming operations) resulting in a finished wheel rim 4 having desired sectional profiles shown in FIG. 3.

But this is unsatisfactory for the purpose for which the invention is concerned for the following reasons: Firstly, a variety of expensive rollers are employed in the roll forming operations in order to manufacture a wheel rim having desired sectional profiles. Further, such manufacturing processes are complex, time consuming, labor intensive, and excessive energy consumption. This results in an increase of manufacturing cost. Secondly, as stated above a series of forming operations (e.g., press and roll forming operations) are performed on the hoop to form a wheel rim having desired sectional profiles. But the formed wheel rim may be deformed or too thin due to non-uniform pressing in these manufacturing processes. As a result, the formed wheel rim is unbalanced in weight or unacceptable low in hardness, thus adversely shortening the useful life of wheel rim. Thus improvement exists.

SUMMARY OF THE INVENTION

It is therefore an object of the present invention to provide a method of manufacturing a wheel rim for a motor vehicle comprising the steps of (a) forming a strip of aluminum alloy sheet material having a predetermined cross-section suitable for forming into a wheel rim by extrusion molding; (b) pressing the strip step-by-step lengthwise by an upper mold and a lower mold having complimentary profiles for causing the strip to have predetermined profiles as a hoop with a formed gap between the both ends; (c) welding the gap to form an unfinished wheel rim; and (d) annealing, shaping, heat treating, and polishing the unfinished wheel rim to form a finished wheel rim.

The above and other objects, features and advantages of the present invention will become apparent from the following detailed description taken with the accompanying drawings.

DETAILED DESCRIPTION OF THE PREFERRED EMBODIMENTS

Figure 1:
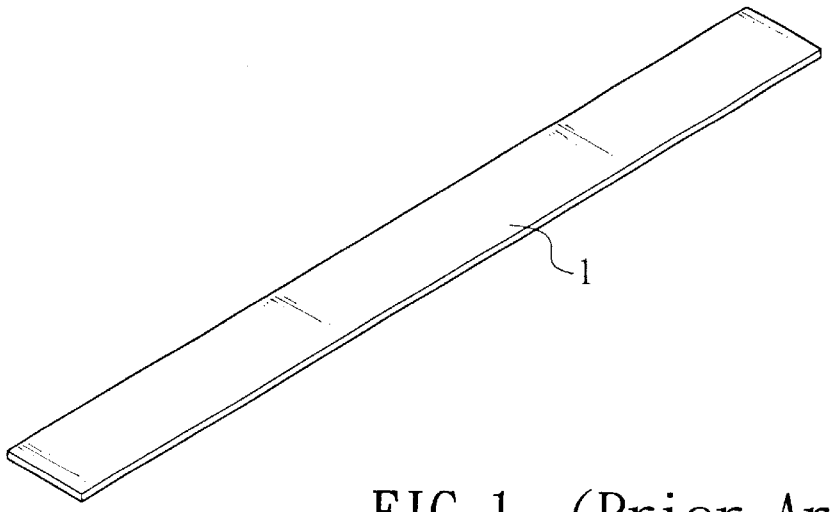
FIG. 1 (Prior Art)
FIG. 1 is a perspective view showing a strip of sheet material used to form a wheel rim by a conventional manufacturing method.
Figure 2:
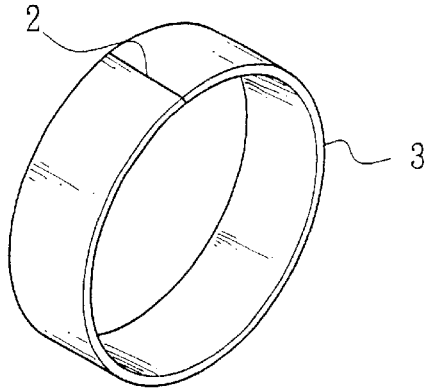
FIG. 2 (Prior Art)
FIG. 2 is a perspective view showing the strip of FIG. 1 formed into a hoop.
Figure 3:
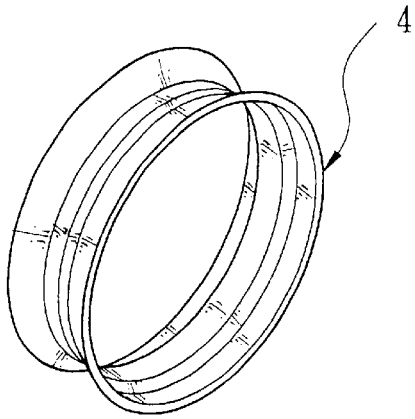
FIG. 3 (Prior Art)
FIG. 3 is a perspective view showing the wheel rim of FIG. 1 in its final configuration.
Figure 4:
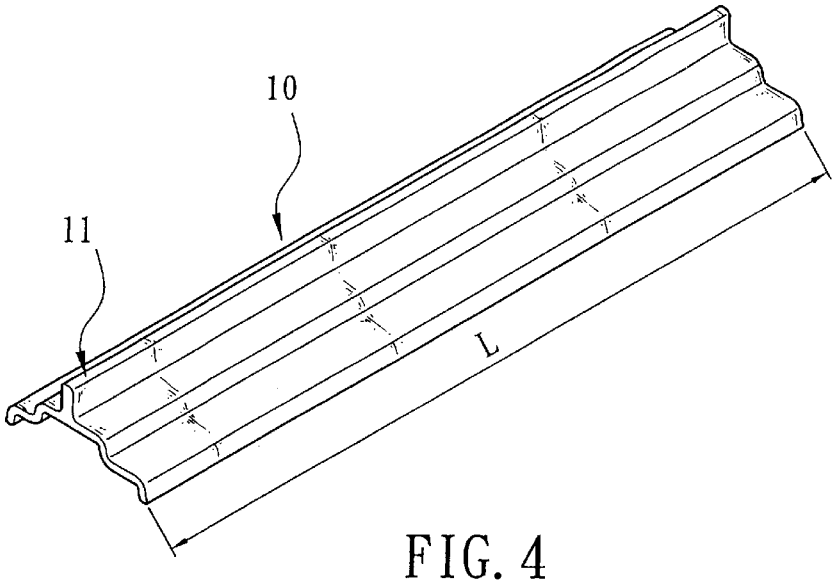
FIG. 4 is a perspective view showing an unfinished wheel rim of aluminum according to a first preferred embodiment of the method of the invention.
Figure 5:
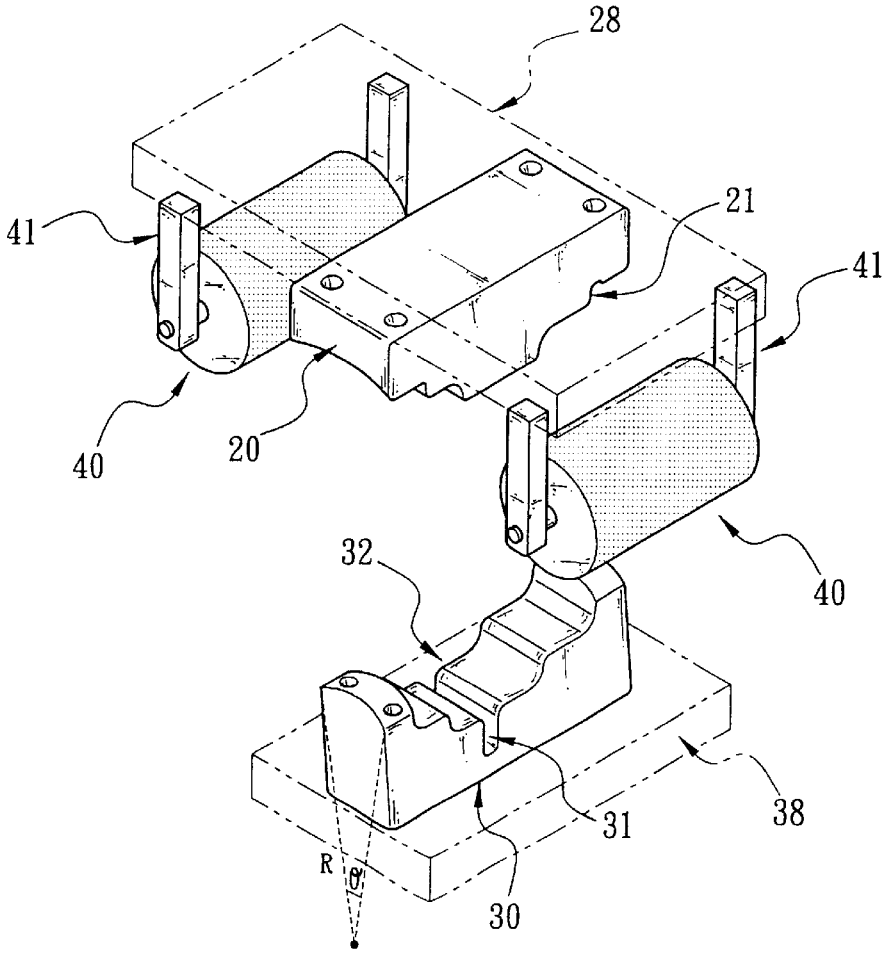
FIG. 5 is a perspective view showing molds and rollers used to form the wheel rim according to the method of the invention.
Figure 6:
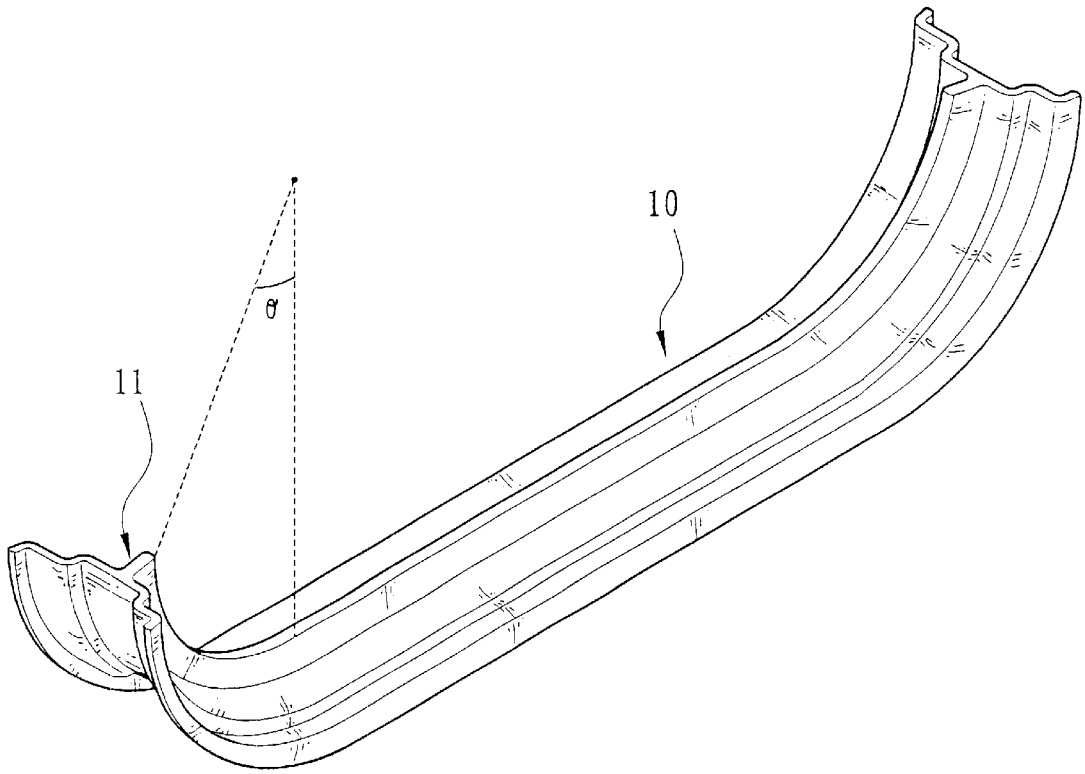
FIG. 6 is a perspective view showing an unfinished wheel rim of aluminum according to a second preferred embodiment of the method of the invention.
Figure 7:
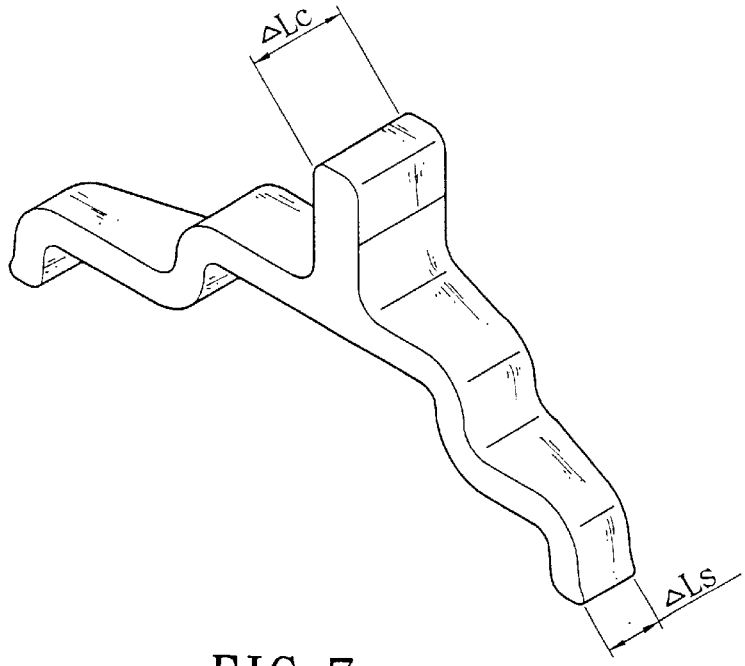
FIG. 7 is a fragmentary enlarged view of FIG. 6.

Referring to FIGS. 4 to 6, there is shown a method of manufacturing an aluminum alloy wheel rim in accordance with the invention comprising the steps of extrusion molding an aluminum alloy into a strip 10 of aluminum alloy sheet material having a predetermined cross-section suitable for forming into a wheel rim, pressing the strip 10 by an upper mold 20 and a lower mold 30 respectively, and bending both ends of strip 10 to form a bent end having a predetermined curvature $\oplus$.

FIGS. 4 and 5 show a first preferred embodiment of the invention. Upper mold 20 and lower mold 30 are coupled to and activated by a lever 28 and a seat 38 of an hydraulic press respectively. The pressing sides 21 and 32 of upper mold 20 and lower mold 30 have cross-sections which conform with the predetermined cross-section of the strip 10, thereby allowing the strip 10 to be placed between molds 20 and 30. A roller 40 is provided on either side of the upper mold 20. The wheel mounts 41 of roller 40 are also coupled to and activated by the lever 28 of the hydraulic press. In the manufacturing processes, both ends of strip 10 are bent by the upper mold 20 and lower mold 30 first to form a predetermined curvature $\ominus$. Once the hydraulic press is activated, the pressing sides 21 and 32 of the upper mold 20 and lower mold 30 will press on the strip 10 and apply bending forces to the strip 10 along the longitudinal axis of the strip 10 in opposite directions, thus forming a predetermined curvature $\ominus$ on the position being pressed. The degree of curvature $\ominus$ is preferably in the range between 15 to 60 degrees. Further, the radius of curvature $\ominus$ is substantially the same as that of formed wheel rim. During the manufacturing processes, the roller 40 will push the unchanged section of strip 10 adjacent to the deformed section to a position continuously along the curvature $\ominus$ in order to prevent an undesired discontinuous deformation of strip 10 between the formed section of strip 10 and the adjacent unchanged section thereof.

Figure 8:
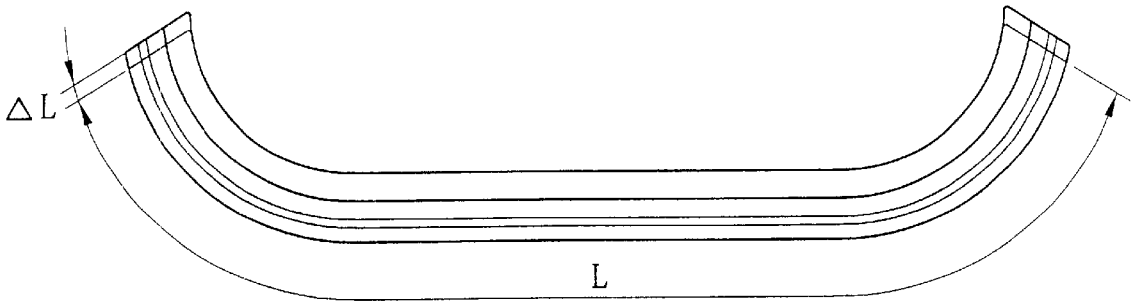
FIG. 8 is a side view of FIG. 6.
Figure 9:
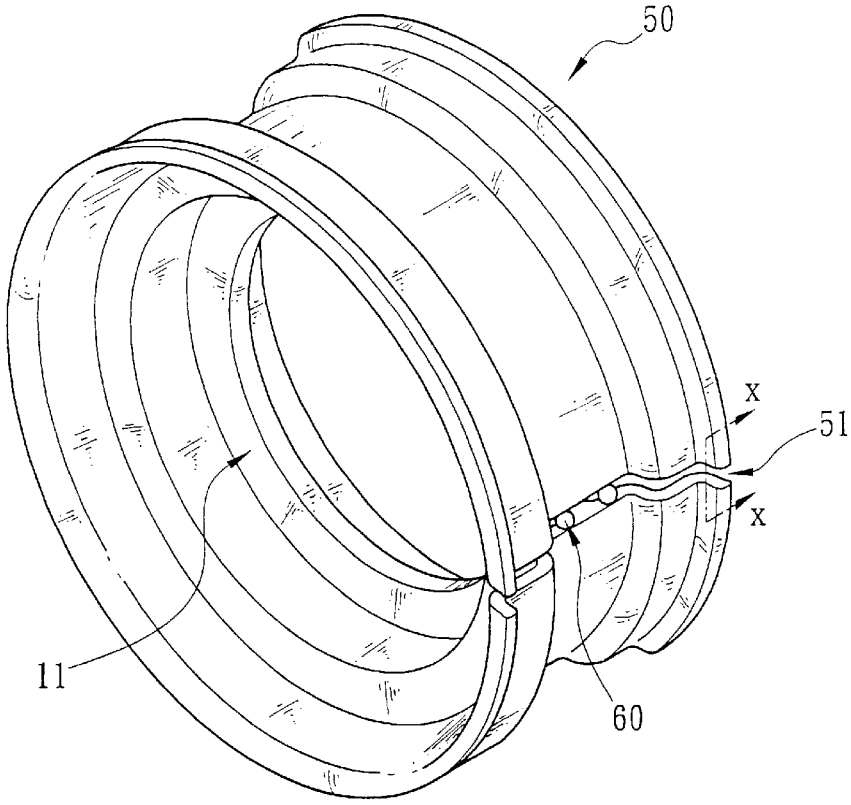
FIG. 9 is a perspective view showing the wheel rim of FIG. 6 formed into a hoop.
Figure 10:
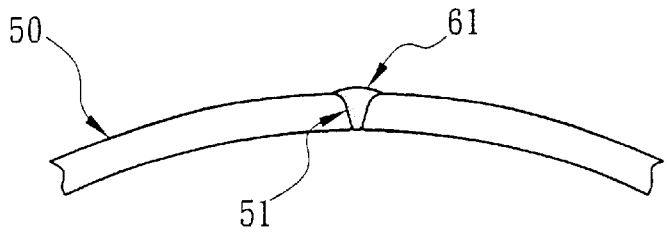
FIG. 10 is a sectional view taken along line X—X of FIG. 9 showing a soldering of the hoop for forming a wheel rim.

After both ends of strip 10 are bent to form a predetermined curvature e, a lengthwise non-uniform deformation exists in both ends of strip 10 due to molecular compression of the metal strip 10. The deformation $\Delta Lc$ in the center of the lengthwise direction of strip 10 is larger than $\Delta Ls$ in either side thereof. For ensuring strip 10 to be formed as a hoop and a gap formed between two ends of the hoop after performing subsequent forming processes, a non-uniform deformation $\Delta L$ on either end of strip 10 will be cut out by a bench saw as shown in FIG. 8 and only a desired length L of strip 10 will be preserved. Moreover, a milling machine is used to form a guide angle on either end of strip 10. As such, both ends of strip 10 may be proximate to each other after strip 10 is formed as a hoop. Then strip 10 is again placed between molds 20 and 30. The unchanged section of strip 10 is pressed step-by-step by molds 20 and 30 lengthwise and bent subsequently to form a hoop 50 (referring to FIG. 9) having a V-shaped gap 51 formed between both ends thereof. A point soldering 60 is performed on the gap 51 for partially connecting both ends of hoop 50 together. Then welding is performed on V-shaped gap 51 to melt the aluminum alloy solder 61 so as to unite the both ends of strip 10 together (referring to FIG. 10). An unfinished wheel rim 50 is thus formed.

The unfinished wheel rim 50 is annealed to eliminate stress concentration in the gap 51 portion. After being annealed, the unfinished wheel rim 50 is placed between an upper mold 81 and a lower mold 82 of another hydraulic press where the upper mold 81 and lower mold 82 are activated by another hydraulic press respectively to form a wheel rim having the same profiles as the junction of molds 81 and 82 (since molds 81 10 and 82 have complimentary profiles). Also, any irregularity formed on the unfinished wheel rim 50 will be eliminated after molds 81 and 82 press on the inner face of unfinished wheel rim 50. This substantially forms an unfinished wheel rim 50 having a desired size. Finally a series of heat treatment processes are performed on the unfinished wheel rim 50 so as to cure the metal material and increase the strength. Moreover, a polishing is performed on uneven portion of the unfinished wheel rim 50 to form a finished wheel rim having a smooth surface.

Figure 12:
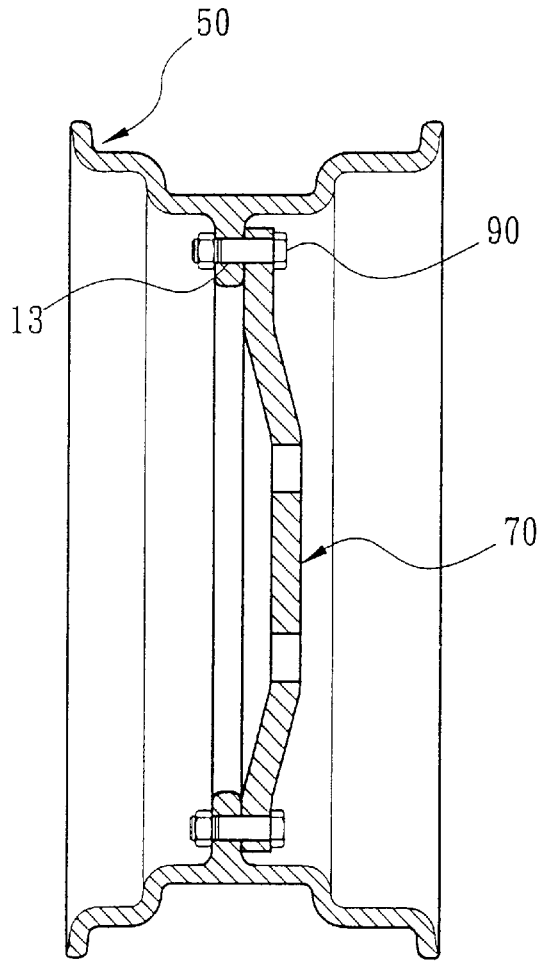
FIG. 12 is a sectional view showing the assembly of wheel rim of the invention with a disk.
Figure 11:
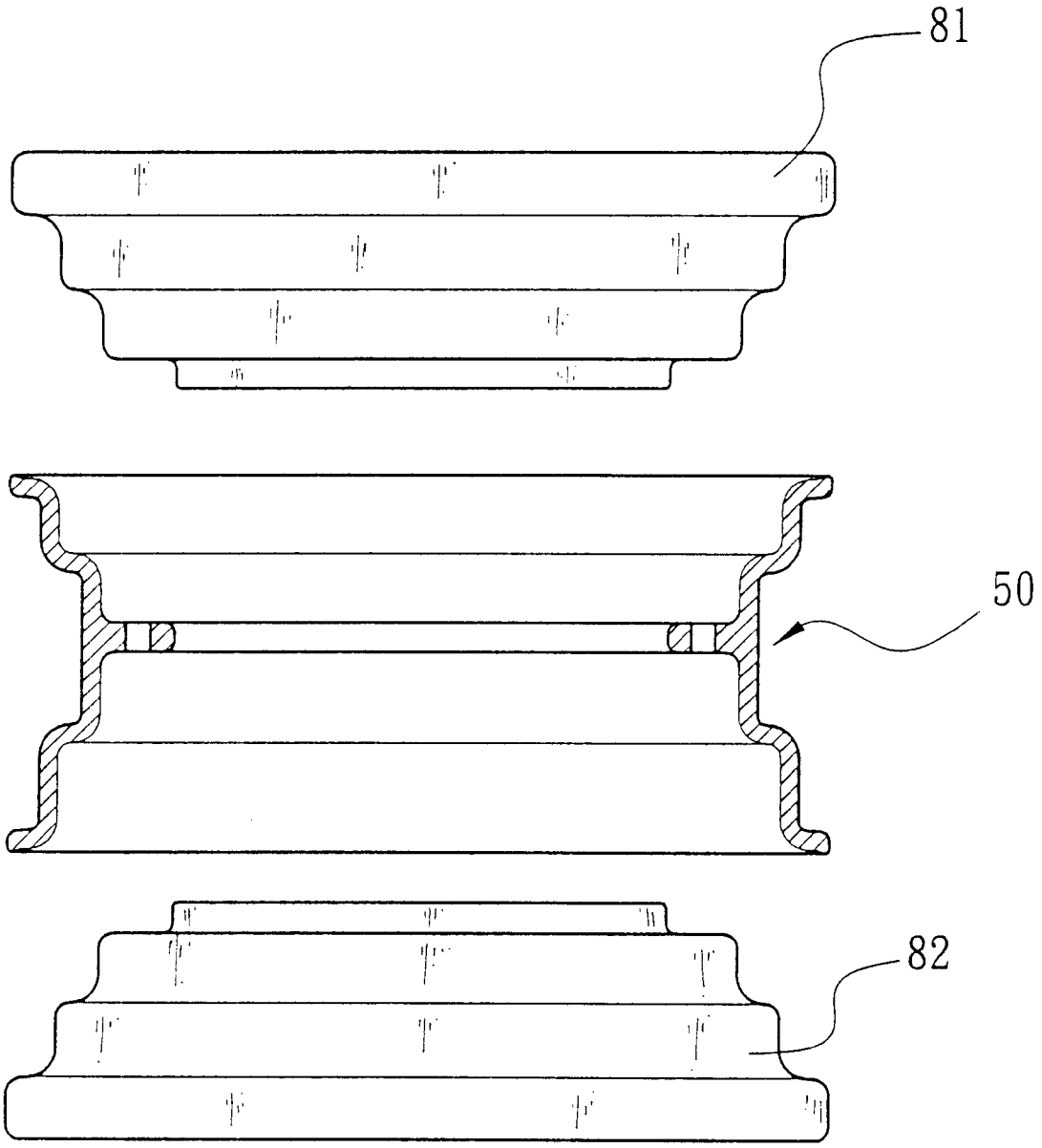
FIG. 11 is a sectional view showing the deformed hoop of FIG. 9 after undergoing the step of molding.

In another preferred embodiment of the method of the invention (FIG. 4), a strip 10 of aluminum alloy sheet material having a predetermined cross-section suitable for forming into a wheel rim by extrusion molding further comprises a lengthwise rib 11 thereon. In the second preferred embodiment of the method of the invention (FIG. 6), strip 10 is then placed between molds 20 and 30 facing a pressing side 21 and a pressing side 32 thereof respectively. Upper mold 20 and lower mold 30 are activated by a hydraulic press. A well 31 is provided on pressing side 32 sized to receive the rib 11. Then a series of forming operations (e.g., press and roll forming operations) are performed on strip 10 to form a hoop. Thereafter, welding, annealing, shaping, heat treatment, and polishing operations are performed to form a finished wheel rim 50 having a perimetric rib 11 along inner side. Also, a plurality of equally spaced holes 13 are formed along rib 11 (FIG. 12). A plurality of fasteners 90 are driven to fix a disk 70 onto the rib 11 of wheel rim 50 through the holes 13. The wheel rim 50 may then be installed to axle of a motor vehicle to secure them together via the disk 70. In brief, the advantages of the invention are the following: the equipment required is simple and inexpensive. The quality of formed aluminum alloy wheel rim is high. No welding operation is required for fastening wheel rim 50 and disk 70. The provision of rib 11 greatly enhances the strength of finished wheel rim 50.

While the invention has been described by means of specific embodiments, numerous modifications and variations could be made thereto by those skilled in the art without departing from the scope and spirit of the invention set forth in the claims.

What is claimed is:

1. A method of manufacturing a wheel rim for a motor vehicle comprising the steps of:

a) extrusion molding an aluminum alloy into a strip having a predetermined cross-section suitable for forming into a wheel rim;

b) placing a portion of said strip between an upper mold and a lower mold, said upper and lower mold having a cross-sectional configuration which conforms with said predetermined cross-section of said strip, said upper and lower molds being configured to curve said portion of said strip when said portion of said strip is pressed between said upper and lower molds;

c) pressing said portion of said strip between said upper and lower molds whereby said upper and lower molds engage said strip to produce a portion of said strip having a curve due to the configuration of said upper and lower molds;

d) repeating steps b) and c) a plurality of times on uncurved portions of said strip until the entire strip is curved into a hoop with a gap between one end of said strip and another end of said strip, with the proviso that said strip has a length L and that said length L and said curve are selected to produce said gap upon completion of steps a) through d); and then e) welding said gap to produce said wheel rim.

2. The method of claim 1 wherein said strip includes a lengthwise rib (11) thereon.

3. The method of claim 2 wherein said upper mold and said lower mold are coupled and activated by a lever and a seat of an hydraulic press respectively whereby said hydraulic press causes said upper and lower molds to engage said strip.

4. The method of claim 3 wherein said curve is in the range of 15° to 60°.

5. The method of claim 3 wherein said curve has a radius of curvature which is substantially the same as that of the wheel rim.

6. The method of claim 3 wherein uncurved portions of said strip are placed between said upper and lower molds by a pair of rollers located on either side of said upper mold.

7. The method of claim 6 wherein a first end of said strip and a second end of said strip are curved prior to curving a portion of said strip between said first and second ends.

8. The method of claim 7 wherein said length L of said strip is selected by the further step of cutting out a non-uniform deformation on either end of said strip.

9. The method of claim 8 which further comprises the step of forming a guide angle on either end of said strip by a milling machine so that said gap has a V shaped configuration.

10. The method of claim 9 wherein welding said gap takes place by first performing a point soldering on said gap for partially connecting said one end of said strip to said another end of said strip.

11. The method of claim 10 which further comprises the step of completing the welding by placing melted aluminum alloy solder in said gap to thereby unite both ends of said strip together for forming said wheel rim.

* * * * *